US005364241A

United States Patent [19]

Schultz

[11] Patent Number: 5,364,241

[45] Date of Patent: Nov. 15, 1994

[54] EVACUATION SYSTEM WITH UNIVERSAL LID FOR RIGID CONTAINERS

[75] Inventor: Glen R. Schultz, Yorkville, Ill.

[73] Assignee: Pioneering Concepts Incorporated, Yorkville, Ill.

[21] Appl. No.: 199,786

[22] Filed: Feb. 22, 1994

[30] Foreign Application Priority Data

[81] 786022294 .....

[51] Int. Cl.[5] ..... F04B 39/12; B65B 31/00; B65D 51/16

[52] U.S. Cl. ..... 417/442; 417/553; 215/260; 215/270; 215/311; 220/209; 53/510; 53/88

[58] Field of Search ..... 417/238, 442, 553, 503; 215/228, 260, 270, 311; 220/209, 203; 53/510, 88

[56] References Cited

U.S. PATENT DOCUMENTS

| | | | |
|---|---|---|---|
| 194,617 | 8/1877 | Purdy | 215/311 |
| 561,783 | 6/1896 | Fuerth | 215/260 |
| 1,575,464 | 3/1926 | Tamura | 215/260 |
| 1,601,705 | 9/1926 | Staunton | 141/65 |
| 1,615,772 | 1/1927 | Poole | 215/260 |
| 1,773,311 | 8/1930 | Killen | 215/260 |
| 4,287,819 | 9/1981 | Emerit | 215/260 |
| 4,583,925 | 4/1986 | Hawkins | 417/555.1 |
| 4,763,803 | 8/1988 | Schneider | 215/260 |
| 4,975,028 | 12/1990 | Schultz | 417/442 |
| 5,299,917 | 4/1994 | Schultz | 417/442 |

*Primary Examiner*—Richard A. Bertsch
*Assistant Examiner*—Roland G. McAndrews, Jr.

[57] ABSTRACT

An evacuation system for unlidded rigid containers including a reciprocating piston pump and a universal disc that provides a leak proof lid for ordinary pots, pans or bowls. The disc is flat and accommodates a variety of container sizes as well as minor surface irregularities in the container lip. Vent holes spaced around the perimeter of the disc prevent implosion of the disc into the container if the disc edge is placed too close to the edge of the container. The disc is somewhat flexible and has a sealing surface on one side for proper seating and sealing on the container lip.

8 Claims, 2 Drawing Sheets

EVACUATION SYSTEM WITH UNIVERSAL LID FOR RIGID CONTAINERS

RELATED PATENTS AND APPLICATIONS

Glen R. Schultz, the inventor in this case, is the inventor named in his basic patent entitled "PUMP APPARATUS FOR EVACUATING CONTAINERS", U.S. Pat. No. 4,975,028 issued Dec. 4, 1990. Furthermore, Mr. Schultz is the inventor named in U.S. Ser. No. 018,201 filed Feb. 16, 1993 entitled "EVACUATION PUMP SYSTEM FOR BOTH RIGID AND FLEXIBLE CONTAINERS", as well as the inventor named in U.S. Ser. No. 018,202 filed Feb. 16, 1993 entitled "EVACUATION PUMP SYSTEM WITH CHECK VALVES FOR BOTH RIGID AND FLEXIBLE CONTAINERS", which all relate to the same general subject matter as the present application.

BACKGROUND OF THE INVENTION

This invention relates to a pump apparatus for evacuating containers. The invention is particularly adapted to evacuate air from food storage containers, such as jars and plastic bags.

The prior art is prolific in patents that disclose various types of pumps for evaluating air from food containers. The most pertinent patents to the general subject are believed to be the following:

Gill, U.S. Pat. No. 29,582
Winters, U.S. Pat. No. 638,383
Desmond, U.S. Pat. No. 882,874
Staunton, U.S. Pat. No. 1,601,705
Herzog, et al., U.S. Pat. No. 2,401,638
Crook, U.S. Pat. No. 2,648,474
Haley, U.S. Pat. No. 2,695,741
Reisinger, U.S. Pat. No. 3,312,256
Katell, U.S. Pat. No. 3,313,444
Ruberg, U.S. Pat. No. 4,278,114
Maruscak, U.S. Pat. No. 4,337,804
Scanlan, U.S. Pat. No. 4,478,025
von Bismarck, U.S. Pat. No. 4,575,990
Hawkins, U.S. Pat. No. 4,583,925
Bartle, Sr., U.S. Pat. No. 4,745,730
European Patent No. 0 117 247, 1984
German Patent No. 33 35 001, 1983
Swiss Patent No. 200,360, 1939

These patents disclose pumps for evacuating either rigid containers(jars) or deformable containers (plastic bags), but not both. Additionally, these arrangements employ complex and difficult to apply check valves to the covers(or lids) of rigid containers to be evacuated.

The pump apparatus in the Schultz, U.S. Pat. No. 4,975,028 issued Dec. 4, 1990, entitled "PUMP APPARATUS FOR EVACUATING CONTAINERS" consists of three principal components; in particular, (1) a specially designed disposable/reusable, pressure-sensitive, adhesive-tape check valve that adheres to a container lid and covers a small air evacuating hole, (2) a reciprocating two-stroke piston pump that features an efficient piston check-valve and a vacuum cup which cooperate with plugable porting to provide for evacuation of both rigid and deformable containers, and (3) an accessory probe which is plugged into a side plugable port of the pump to evacuate deformable containers such as plastic bags, while the bottom plugable port is plugged.

With this pump apparatus, a jar can be reused thousands of times to store anything that will fit and which will keep better in a vacuum. The apparatus also pulls a vacuum on an ordinary plastic zipper-lock type bag and allows the zipper to be closed without losing the vacuum. The apparatus will also evacuate many leak proof bags that might be sealed with a commercial home-style hot-sealing machine.

While the Schultz patented design works well and has achieved considerable commercial success, he devised an improved pumping system that eliminates the need for a check valve in the flexible probe assembly and the requirement for a removable plug to maintain cup suction. The prior in-line check valve has many parts and was difficult to manufacture and expensive to purchase preassembled. The removable plug works well in maintaining suction in the cup but it is easily lost and its use requires careful operator instruction.

In accordance with the invention shown in my U.S. patent application, Ser. No. 018,201, an improved evacuation pump system was provided that is uniquely designed to evacuate both lidded rigid containers and sealable flexible containers with a quick change valve shiftable from one mode to the other without removing or replacing parts.

Toward these ends an elastomeric vacuum cup is shown in that application that also forms one of the end caps for the pump assembly, releasably attached to the lid of a rigid container in the rigid container evacuation mode. This elastomeric cup and end cap, has a cross bore therein that receives a shiftable valve member having an outlet port at one end that releasably connects in one position thereof to a flexible probe utilized in the flexible bag evacuation mode. The valve member is shiftable to a second position where it communicates the interior of the vacuum cup in the rigid container evacuation mode to the pumping chamber and seals the outlet port for the flexible container evacuation probe.

These improvements eliminate the need for the plugs associated with the pumping apparatus described in connection with my U.S. Pat. No. 4,975,028, which not only are easily lost but make the pumping apparatus significantly more difficult to operate, particularly without instructions.

In accordance with the invention shown in my U.S. patent application, U.S. Ser. No. 018,202, an evacuating pumping system was provided that operates in two distinct modes to evacuate flexible containers and rigid containers, and the switch between modes is effected by the insertion or removal of a tethered plug from a single port.

Toward these ends a pump was provided in that application with two inlet ports, one for the flexible evacuation probe and one for the vacuum cup interior. The probe port is selectively closed by a plug that is tethered to the pump to prevent its loss. The pump is provided with a main central inlet passage that connects to both of these inlet ports, the probe port being connected thereto by a transverse passage that intersects the inlet passage, and the suction cup port is a coaxial extension of the inlet passage.

A first check valve is defined by a ball valve and seat in the main inlet passage between the transverse bore and the pumping chamber and operates to block flow to the flexible probe during the discharge stroke of the piston in the flexible bag evacuation mode. A second check valve is defined by another ball and valve seat in the inlet passage but these are positioned between the transverse passage and the vacuum cup. This check valve maintains suction in the cup during the flexible bag evacuation mode which would otherwise be lost in the piston discharge stroke.

Neither of these check valves has any function in the rigid container evacuation mode because they both float in that mode. In that mode the lid mounted valve prevents discharge flow into the container and the removable plug, then in place, prevents flow into the flexible probe port. Since both valves open toward the pumping chamber, neither interfere with rigid container evacuation during the suction stroke.

These two check valves considerably simplify the operation of the pump. When switching from the rigid container mode to the flexible container mode, the plug is removed and the flexible probe inserted in the probe port. The plug cannot be lost because it is tethered to the pump and it is unnecessary to plug the suction cup part as before. Switching back to the rigid container mode is simpler because the user can easily understand without instruction that the flexible probe port needs to be plugged by the plug tethered next to it, and there is of course no need to tell the user to then remove the vacuum cup plug as before because it has been eliminated and its function is achieved automatically by one of the check valves.

There have in the past been provided specially adapted lids for evacuation systems that improve the sealing characteristics over lids originally supplied with the containers by the food processor. The following is a list of patents found in a patentability search particularly related to this subject:

U.S. Pat. No. 1,857,015, C. M. Gere
U.S. Pat. No. 1,941,048, W. F. Punte
U.S. Pat. No. 2,214,346, H. E. Pim
U.S. Pat. No. 2,322,236, H. Ingram
U.S. Pat. No. 2,429,984, R. M. Berglund
U.S. Pat. No. 2,772,018, G. Weiss
U.S. Pat. No. 3,313,444, Katell
U.S. Pat. No. 3,581,881, J. C. Hobbs, II
U.S. Pat. No. 4,210,255, Pan
U.S. Pat. No. 4,249,583, Lundbladh In the Lundbladh, U.S. Pat. No. 4,249,583, a reciprocating pump has a lower rim that is removable from an in situ cover. The cover can be made of plastic and has a short outer rim that surrounds a sealing gasket. The cover stays in place on the container and is essentially flangeless in terms of the lip on the container. Lundbladh states in column 5, "In order to be able to cover containers of widely different dimensions with the same closing cover - - - ". Thus, Lundbladh apparently envisioned using the same cover to accommodate different size containers.

The Katell, U.S. Pat. No. 3,313,444, shows a sealing ring that projects downwardly from a flat cover. Katell does not state that he intends the cover to be utilized with various diameter containers.

While the above prior art is adequate for many purposes, the present invention seeks to provide an improved universal lid for an evacuation system.

SUMMARY OF THE PRESENT INVENTION

In accordance with the present invention, an evacuation system is provided for unlidded rigid foodstuff containers including a reciprocating piston pump and a universal lid or disc that replaces the container's original lid. The system is designed principally for, but not limited to pots, pans and bowls that frequently have no lids. This disc is specially designed to accommodate a variety of container diameters and it includes features to assure the disc is properly centered prior to evacuation and that minimize the possibility of the disc imploding into the container after significant build up of vacuum caused by successive strokes of the pump.

Toward these ends the disc is constructed preferably of a hard aluminum sheet that is sufficiently thin so that it can accommodate minor waviness in the container's upper lip. The closeness of the disc to the edge of the container poses a problem of disc implosion into the container. To eliminate this implosion problem, while at the same time providing a universal lid to accommodate a variety of size containers, a plurality of vent holes are spaced around the perimeter of the disc. These vent holes prevent container evacuation in the event the disc is used with too large a diameter container or if the disc is sufficiently off-center. One can easily imagine if an unvented disc were placed off center on a container having the disc edge very close to the edge of the container, the disc, as it increasingly dishes or assumes a concave configuration because of its flexibility as the vacuum builds, would easily implode into the container not only destroying the usability of the container and its contents but the disc as well. This problem of course does not exist with the present vented disc.

An elastomeric disc is provided between the aluminum disc and the container lip to assure good sealing and to accommodate minor surface irregularities in the lip. In one embodiment, the elastomeric disc has a plurality of apertures corresponding in size and location to the apertures in the aluminum disc. While the apertures in the elastomeric disc are shown in alignment with those in the aluminum disc, such alignment is not essential since venting will still occur between the aluminum disc and the elastomeric disc since the elastomeric disc is quite flexible and separates from the other disc during the pump evacuation stroke.

In another embodiment of the present invention the elastomeric disc has a diameter smaller than the aluminum disc and has no vent apertures which results in a somewhat less costly construction.

While in some cases the elastomeric disc may be bonded to the aluminum disc, such attachment is unnecessary for proper operation of the universal lid assembly.

Other objects and advantages of the present invention will appear more clearly from the following detailed description.

Figure 8:
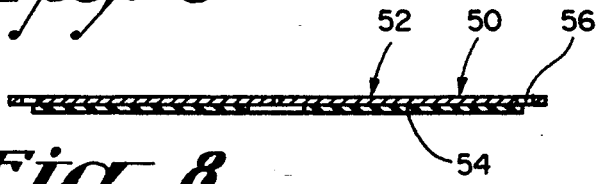

FIG. 8 is an alternate embodiment of the universal disc assembly also according to the present invention.

DETAILED DESCRIPTION OF THE PREFERRED EMBODIMENT

Figure 1:
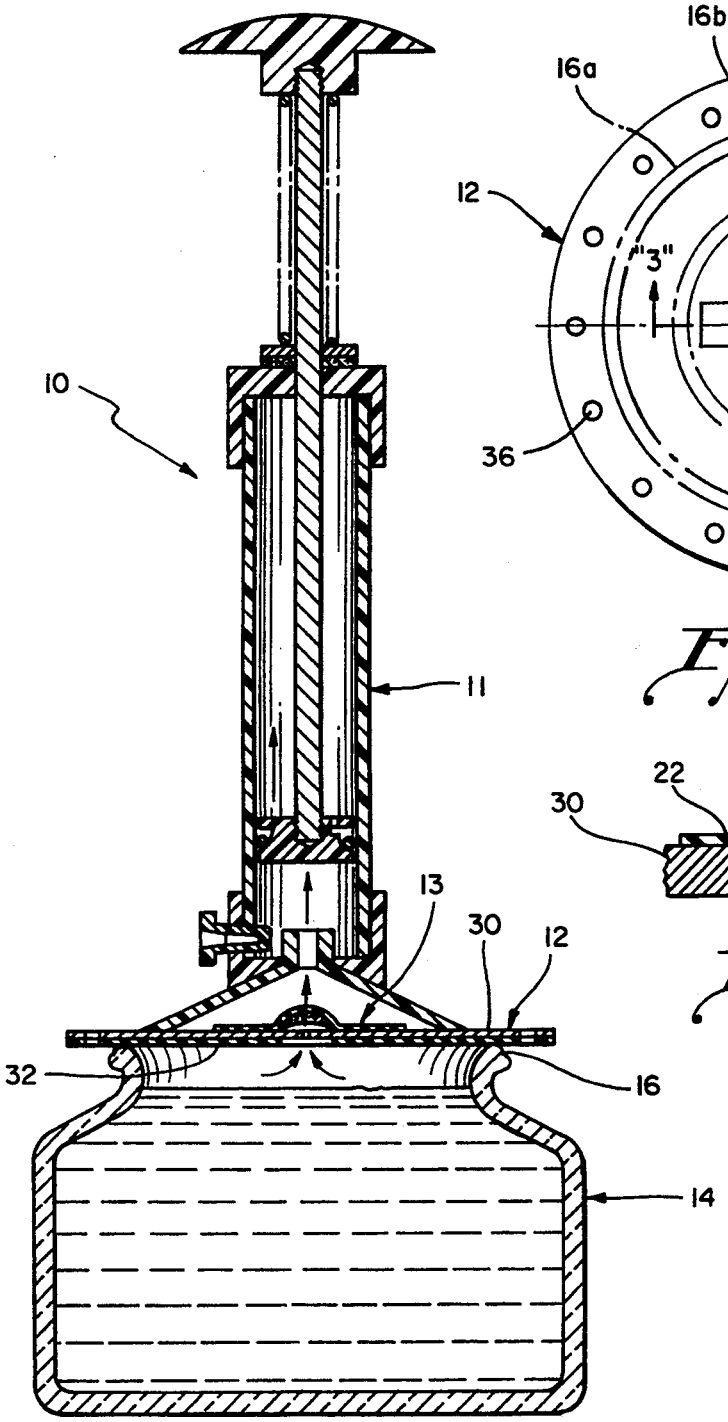
FIG. 1 illustrates an evacuation system according to the present invention perched atop a standard glass jar container with its original lid removed.

Referring to the drawings and particularly FIG. 1, an evacuation system 10 is illustrated according to the present invention and generally includes a reciprocating piston pump 11, a universal disc lid assembly 12 carrying a tab type check valve 13 mounted atop a rigid foodstuff carrying container 14 having an annular upper lip 16. In use, the universal lid 12 placed on the top of a pot, pan, bowl or other container 14 with the check valve 13 positioned as shown, and then the pump assembly 11 is placed on top of the disc over the check valve 13 and the pump is reciprocated to evacuate air from the container 14. After evacuation, the pump assembly 11 is removed and the universal lid 12 and check valve 13 remains in place until one desires to remove some of the contents of the container and at that time the check valve 13 is released to vent the container interior permitting removal of the universal disc assembly 12.

It should be understood that the details of the evacuation pump 11 form no part of the present invention and the pump assembly is described in detail in the Schultz, U.S. Pat. No. 4,975,028, and the details of construction and its methodology of operation are discussed in appropriate detail in the Schultz prior patent, and the description thereof is incorporated herein by reference.

Check valve 13 is also of the same construction as the check valve shown in the prior Schultz U.S. Patent, and is seen to include a plastic strip 20 having an adhesive underneath ends 21 and 22. One end or the center of the check valve 13 can be manually lifted to release the vacuum in the container. The central section 23 has a sealing material 24 that covers the aperture in the disc assembly 12 but at the same time lifts up during the suction or evacuation stroke of the pump 11 to permit evacuation of air from container 14.

The universal disc assembly 12 according to the present invention is seen to include a thin aluminum circular disc 30(or alternatively a reinforced plastic disc with similar strength and flexibility characteristics) and a lower elastomeric disc 32. The aluminum disc 30 is constructed of a hard or aircraft type aluminum such as 5052H36 or H38($\frac{3}{4}$ hard or full hard) in the range of 0.048 to 0.052 inches in thickness. If used with a softer aluminum, the aluminum disc thickness can range up to 0.125 inches. The harder aluminum disc is preferable because it prevents the disc from taking a permanent set as the disc "dishes" upon full vacuum, while permitting the flexibility necessary to accommodate somewhat wavy container lips.

Figure 3:
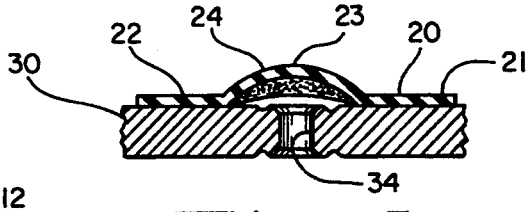
FIG. 3 is an enlarged fragmentary section taken generally along line 3—3 of FIG. 2 with the elastomeric disc removed.
Figure 4:
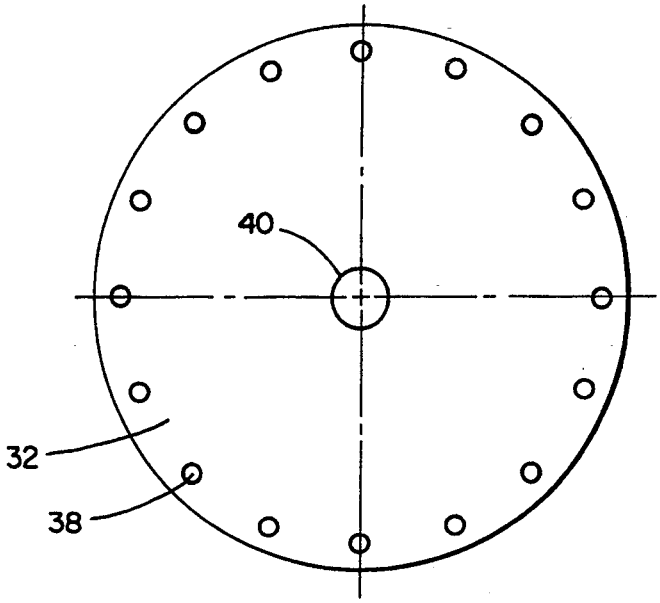
FIG. 4 is a bottom view of the universal disc assembly illustrated in FIG. 1 viewing the lower surface of the elastomeric disc.
Figure 5:
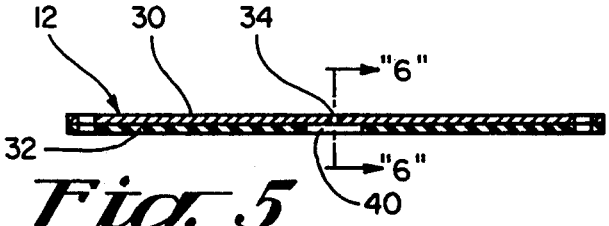
FIG. 5 is a diametral cross-section through the present universal disc assembly.
Figure 6:
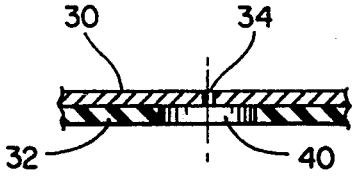
FIG. 6 is an enlarged fragmentary section of the center of the disc assembly illustrated in FIG. 5.

The aluminum disc as shown in FIG. 3, has a central aperture 34 therein. Aperture 34 has a diameter of approximately 1/16th inch and may be punched and coined in the aluminum disc 30 as a cost-saving measure over a separate drilling and deburring operation. Hole 34 can be punched and coined with the same tool that stamps the disc.

The elastomeric disc 32 is constructed of an FDA rubber or synthetic material and preferably has a durometer in the range of 25 to 70 Shore A. The elastomeric disc provides an air-tight seal between the aluminum disc and the container rim. It should be thick enough and soft enough to conform to slightly irregular or rough rim containers to be sealed.

Figure 2:
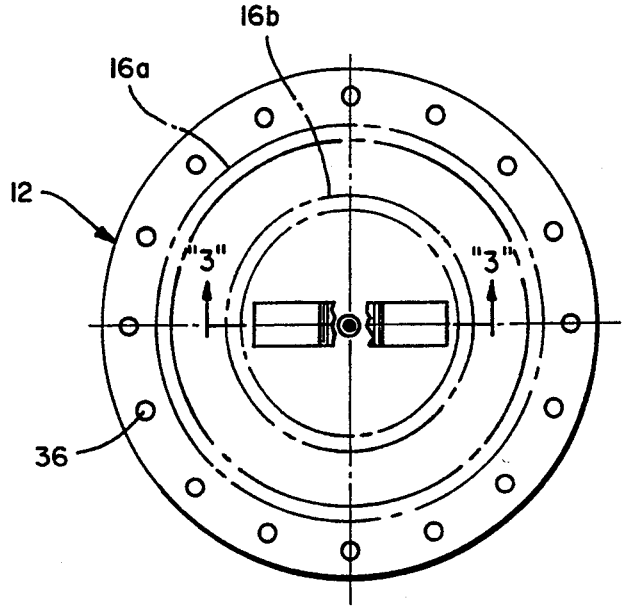
FIG. 2 is a top view of the universal lid sub-assembly illustrated in FIG. 1.

In the embodiment illustrated in FIGS. 1 to 7, a plurality of vent holes 36 is provided around the perimeter of the aluminum disc 30 and similar vent holes 38(shown in FIG. 4) are provided in the elastomeric disc 32. While the holes 36 and 38 are shown aligned with one another, it is unnecessary that they be aligned for proper venting operation, bearing in mind that the aluminum disc 30 is not bonded to the elastomeric disc 32, although such bonding is within the scope of the present invention. The elastomeric disc 32 has a central aperture 40 aligned with the smaller aperture 34 in the aluminum disc 30 as seen clearly in FIGS. 5, 6 and 7. Container lips 16*a* and 16*b* are illustrated in FIG. 2 to pictoralize the different diameter containers, and more particularly different diameter container lips that can be accommodated with the present invention.

However, if a container having a lip diameter significantly greater than that shown at 16*a* is utilized, then the vent holes 36 will open to the container interior and prevent container evacuation. Similarly, if the user does not center the lid assembly 12 appropriately on the container, one or more of the vent holes 36, 38 will communicate with the container interior and prevent evacuation.

The vent holes 36 and 38 may be approximately $\frac{1}{8}$th to 5/32nd inches at $22\frac{1}{2}$ degree arc distances about the periphery of the two discs, yielding 16 holes each for holes 36 and 38.

The universal disc assembly 12 may be provided in two sizes, one on the order of $8\frac{1}{2}$ inches in total diameter, and the other on the order of $11\frac{1}{2}$th inches in total diameter. The smaller of course for the lower diameter range of containers and the larger, of course, for larger diameter range of containers.

It should be understood that the vent holes 36, the central aperture 34, and the disc 30 itself can be stamped in a basic aluminum sheet all at the same time providing a relatively low cost of manufacture.

Figure 7:
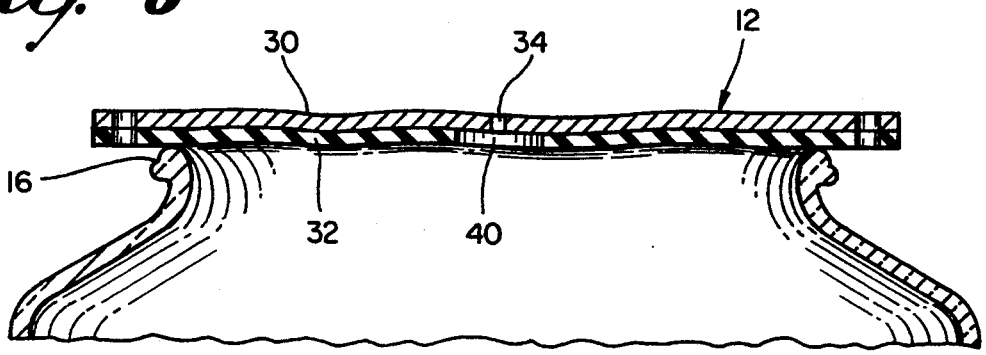
FIG. 7 is a fragmentary section of a container with the disc assembly illustrated in FIGS. 4, 5 and 6 mounted thereon conforming to irregularities in the surface of the container lip.

As shown in FIG. 7, the disc assembly 12 because of the thinness of aluminum disc 30 and the flexibility of the elastomeric disc 32, can conform to container lips 16 having a substantial wavy contour.

According to another embodiment of the present invention, a disc assembly 50 may be provided with an aluminum disc 52 identical to disc 30 but with a smaller diameter elastomeric disc 54. The diameter of disc 54 is slightly greater than the diameter of the disc 50 between the inside edges of diametrically opposed apertures 56. This eliminates the necessity for forming vent holes in the elastomeric disc while at the same time maintaining the function thereof.

I claim:

1. An evacuation system for rigid containers having a generally annular upper lip, comprising: an evacuation pump including a cylindrical housing having a pumping chamber with a lid seal at one end, a reciprocating piston in the pumping chamber movable in a suction stroke and a pressure stroke, valve means in the pump for releasing pressure during the pumping stroke of the piston, and a reusable vacuum lid to accommodate a variety of diameter container lips including generally annular disc means, said disc means having a generally central aperture therethrough communicating the container interior with the pumping chamber with the pump lid seal engaging one side of the vacuum lid, a check valve on the pump side of the disc means preventing air flow into the container even after removal of the pump from the disc means, seal means on the other side of the disc means to seal the disc means to the container lip, said disc means being flexible to accommodate and seal on irregular container lip contours, and means for minimizing implosion of the flexible disc means into the container after sufficient vacuum had built up including a plurality of vent apertures in the disc means spaced radially outwardly from the center of the disc means beyond the diameter of the lip on the largest diameter container for which the disc means is designed.

2. An evacuation system for rigid containers having a generally annular upper lip, comprising: an evacuation pump including a cylindrical housing having a pumping chamber with a lid seal at one end, a reciprocating piston in the pumping chamber movable in a suction stroke and a pressure stroke, valve means in the pump for releasing pressure during the pumping stroke of the piston, and a reusable vacuum lid to accommodate a variety of diameter container lips including generally annular disc means, said disc means having a generally central aperture therethrough communicating the container interior with the pumping chamber with the pump lid seal engaging one side of the vacuum lid, a check valve on the pump side of the disc means preventing air flow into the container even after removal of the pump from the disc means, seal means on the other side of the disc means to seal the disc means to the container lip, and means for assuring approximate disc means centering on the container lip as the evacuation process begins including a plurality of apertures in the disc means spaced radially outwardly from the center of the disc means beyond the diameter of the lip on the largest diameter container for which the disc means is designed.

3. An evacuation system for rigid containers having a generally annular upper lip as defined in claim 1, wherein the disc means is flexible to accommodate and seal on irregular container lip contours, and means for minimizing implosion of the flexible disc means into the container after sufficient vacuum had built up including the vent apertures in the disc means.

4. An evacuation system for rigid containers having a generally annular upper lip as defined in claim 3, wherein the disc means includes a thin flexible disc constructed of a rigid material, said seal means including an elastomeric disc between the flexible disc and the container lip and directly engageable with the container lip, said central aperture extending through each of the flexible disc and the elastomeric disc, said vent apertures extending at least through the flexible disc.

5. An evacuation system for rigid containers having a generally annular upper lip as defined in claim 4, wherein the flexible disc is aluminum means and has a thickness less than 0.125 inches so it is sufficiently flexible to accommodate wavy contours in the container lips.

6. An evacuation system for rigid containers having a generally annular upper lip as defined in claim 4, wherein the elastomeric disc has a diameter less than the diameter of the flexible disc and less than at least part of the vent apertures in the flexible disc, whereby it is unnecessary to form the apertures in the elastomeric disc.

7. An evacuation system for rigid containers having a generally annular upper lip as defined in claim 4, wherein the flexible disc and the elastomeric disc are unconnected to one another, said vent apertures extending through both the flexible disc and the elastomeric disc, whereby rotational misalignment between the vent apertures in the flexible disc and the elastomeric disc will not effect the operability of the vent apertures.

8. An evacuation system for rigid containers having a generally annular upper lip as defined in any of claims 1 to 5, wherein the disc means is flat and circular.

* * * * *